US006568035B2

(12) United States Patent
Zetti

(10) Patent No.: US 6,568,035 B2
(45) Date of Patent: May 27, 2003

(54) SPRUNG HINGE FOR SUPPORTING PANEL-LIKE CLOSURE ELEMENTS

(75) Inventor: Daniele Zetti, Modena (IT)

(73) Assignee: T.G.N. S.p.A., Modena (IT)

( * ) Notice: Subject to any disclaimer, the term of this patent is extended or adjusted under 35 U.S.C. 154(b) by 130 days.

(21) Appl. No.: 09/816,475

(22) Filed: Mar. 26, 2001

(65) Prior Publication Data

US 2001/0025398 A1 Oct. 4, 2001

(30) Foreign Application Priority Data

Mar. 31, 2000 (IT) ..... MO2000U0017

(51) Int. Cl.[7] ..... E05D 15/32; E05F 1/12
(52) U.S. Cl. ..... 16/370; 16/286; 16/308
(58) Field of Search ..... 16/370, 288, 287, 16/286, 302, 308; 312/138.1, 326

(56) References Cited

U.S. PATENT DOCUMENTS 3,363,281 A * 1/1968 Borsani ..... 16/288
3,548,445 A * 12/1970 Dehar ..... 16/292
3,673,635 A * 7/1972 Cencioni ..... 16/358
4,819,298 A * 4/1989 Lautenschlager ..... 16/237
5,035,026 A * 7/1991 Carlo et al. ..... 16/288
5,058,238 A * 10/1991 Lautenschlager ..... 16/278
5,465,463 A * 11/1995 Lautenschlager ..... 16/236
6,141,832 A * 11/2000 Salice ..... 16/366
6,402,270 B1 * 6/2002 Frank ..... 16/366

FOREIGN PATENT DOCUMENTS

FR 1 255 510 6/1961
WO 96 18792 6/1996

* cited by examiner

*Primary Examiner*—Anthony Knight
*Assistant Examiner*—Doug Hutton
(74) *Attorney, Agent, or Firm*—Guido Modiano; Albert Josif; Dadniel O'Byrne

(57) ABSTRACT

An improved sprung hinge for supporting panel-like closure elements is of the type comprising a first articulated quadrilateral and a second articulated quadrilateral which share a first lever and a second lever, and at least first and second elastic elements arranged in series which act on mutually opposite parts of each one of the quadrilaterals, the first lever being formed monolithically.

9 Claims, 3 Drawing Sheets

SPRUNG HINGE FOR SUPPORTING PANEL-LIKE CLOSURE ELEMENTS

BACKGROUND OF THE INVENTION

The present invention relates to an improved sprung hinge for supporting panel-like closure elements, particularly for elements which, in passing from the closed configuration to the open configuration and vice versa, rotate about a substantially horizontal or inclined hinge axis.

Such hinge can be used, for example, to determine the snap opening and closure of doors or leaves of pieces of furniture, caravan cabinets and bins.

Sprung hinges are known which have a double articulated quadrilateral element and two enclosed springs being arranged in series and acting on opposite parts of each one of said two quadrilateral elements.

The two articulated quadrilateral elements share a first lever and a second lever and their base elements are respectively a coupling plate, adapted to be fixed to a fixed component of the piece of furniture (cabinet, bin), and a plate for fixing to the panel-like element.

The first lever is constituted by an elongated body, at one end of which a removable support is coupled by interlocking; the end of the enclosure of one of the two springs acts on said support and the opposite end of the enclosure is anchored to the coupling plate.

The element for articulation between the support and the end of the enclosure is constituted by a pivot on which the shaped bottom of the enclosure engages by rotation.

These hinges are not devoid of drawbacks, including the fact that the first lever is formed in two separate parts, i.e. a body and a support which interlock one another so as to constitute a rigid assembly, and have to be manufactured and machined separately and precisely, consequently increasing production times and costs.

Another drawback of conventional hinges consists in that the element for articulation between the support and the spring enclosure is constituted by a pivot which has to be manufactured, machined and treated separately from the structure of the support and has to be riveted on assembly, and this further increases the production costs of the hinges.

SUMMARY OF THE INVENTION

The aim of the present invention is to eliminate the above-noted drawbacks of conventional hinges, by providing an improved sprung hinge for supporting panel-like closure elements which allows to simplify the manufacture of the elements that constitute it, to eliminate the execution of secondary treatments and machinings of said elements, and to reduce production and assembly times and costs.

Within the scope of this aim, an object of the present invention is to provide a sprung hinge which is simple, relatively easy to provide in practice, safe in use, effective in operation, and relatively low in cost.

This aim and this and other objects which will become better apparent are achieved by the present improved sprung hinge for supporting panel-like closure elements, of the type comprising a first articulated quadrilateral and a second articulated quadrilateral which share a first lever and a second lever and at least first and second elastic means arranged in series which act on mutually opposite parts of each one of said quadrilaterals, characterized in that said first lever is formed monolithically.

BRIEF DESCRIPTION OF THE DRAWINGS

Further characteristics and advantages of the present invention will become better apparent from the detailed description of a preferred but not exclusive embodiment of an improved sprung hinge for supporting panel-like closure elements, illustrated only by way of non-limitative example in the accompanying drawings, wherein.

DESCRIPTION OF THE PREFERRED EMBODIMENTS

Figure 1:
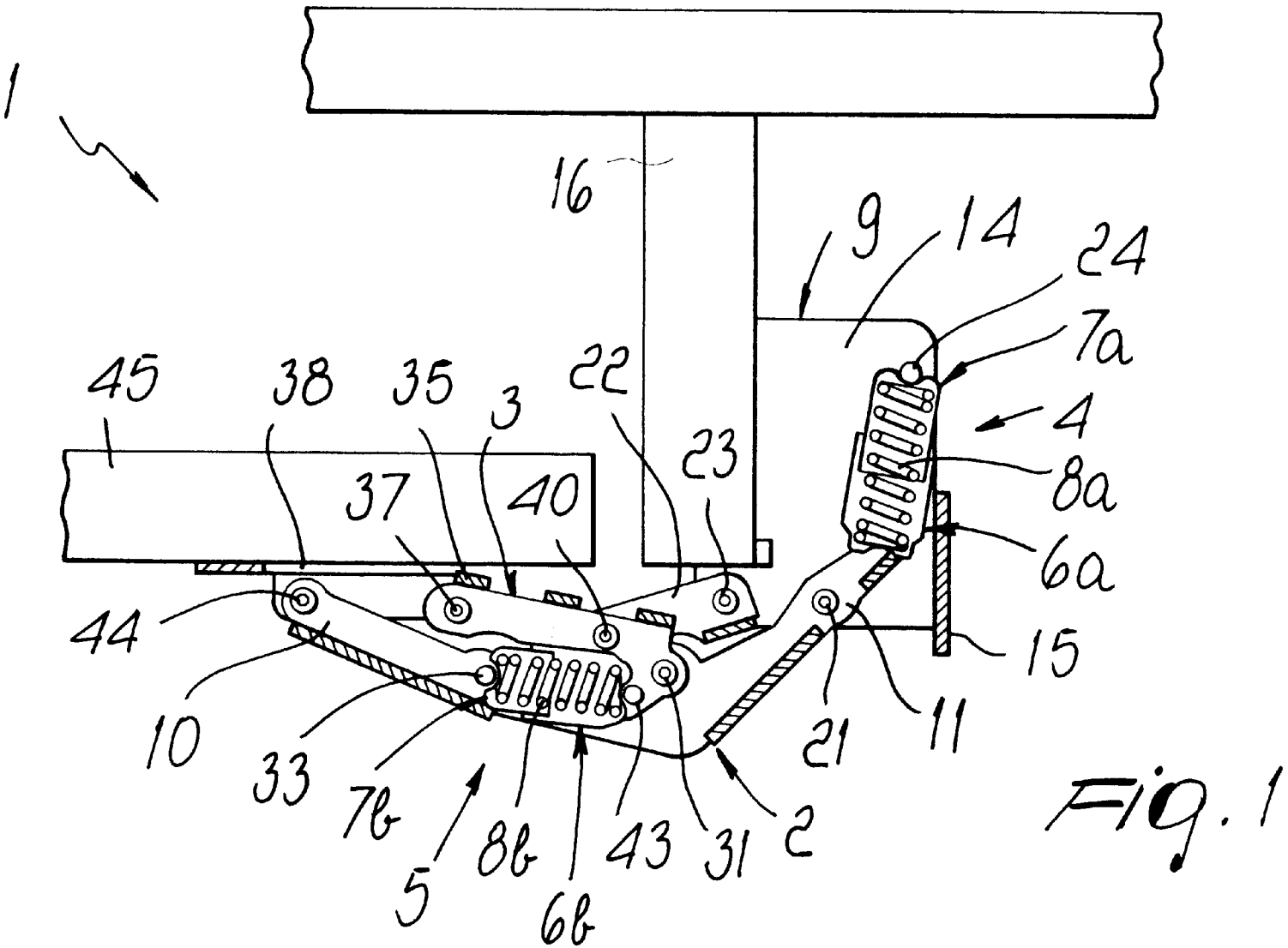
FIG. 1 is a sectional side view of a hinge according to the invention, applied to two panel-like elements in the open configuration.

With reference to the figures, 1 generally designates an improved sprung hinge for supporting panel-like closure elements.

The hinge 1 comprises two articulated quadrilaterals, sharing a first lever 2 and a second lever 3, and at least first elastic means 4 and second elastic means 5 being arranged in series and acting on mutually opposite sides of each one of the two quadrilaterals.

The first lever 2 is formed monolithically, while the first and second elastic means 4 and 5 are constituted by two mutually opposite elements, a lower one and an upper one, which act as a guide and support for a spring.

In the illustrated embodiment, the mutually opposite elements are constituted respectively by bottoms 6*a* and 6*b* and tops 7*a* and 7*b*, each of which being slideable in the corresponding bottom, between which a respective spring 8*a* and 8*b* is contained.

The assemblies formed by a bottom, a top and a spring (6*a*, 7*a*, 8*a* and 6*b*, 7*b*, 8*b*) constitute two elastic telescopic enclosures.

In the first elastic means 4, the top 7*a* is anchored to a coupling plate 9 and the bottom 6*a* is articulated to the first lever 2.

In the second elastic means 5, the top 7*b* is anchored to the arm 10 of the second articulated quadrilateral and the bottom 6*b* is articulated to the second lever 3.

The first lever 2 has an end which is extended by two lug-shaped tabs 11 towards the coupling plate 9 and is articulated to the bottom element 6*a* in order to receive the thrust of the first elastic means 4.

The ends of the lug-shaped tabs 11 are connected one another by a connecting bridge 12 which is monolithic with said tabs and is rotationally coupled to the bottom 6*a* of the elastic means 4.

Advantageously, the outer surface of the connecting bridge 12 is shaped for coupling to the corresponding lower recess formed in the bottom 6*a*.

Figure 5:
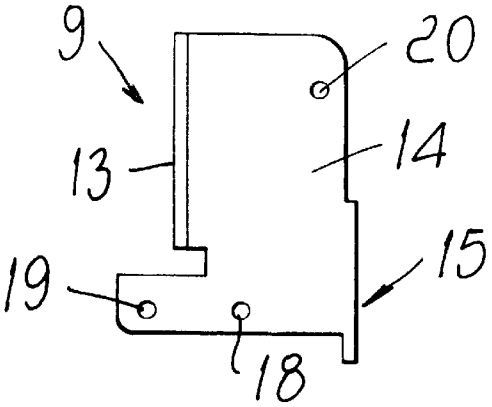
FIG. 5 is a side view of the coupling plate of the hinge according to the invention.
Figure 6:
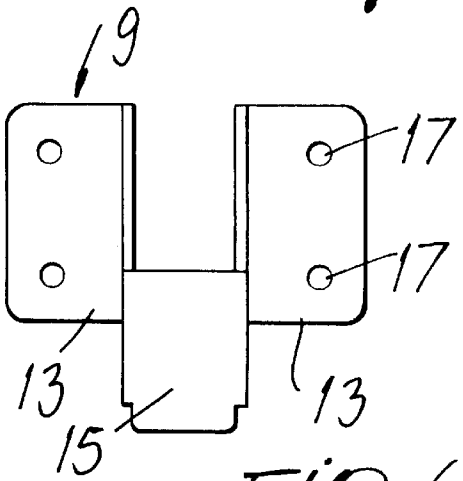
FIG. 6 is a plan view of the plate of FIG. 5.

The coupling plate 9 (FIGS. 5 and 6) is constituted by two fixing bases 13, from which respective side walls 14 extend; said side walls are connected one another by an offset protruding lower bridge 15.

The coupling plate 9 is anchored to an upper panel-like element 16 in a substantially vertical position thanks to the coupling holes 17 formed in the fixing bases 13.

Three holes are formed in each side wall 14: two lower ones 18 and 19, which are formed at the bridge 15, and an upper one 20, which is arranged opposite the lower holes 18 and 19.

The holes 18 of the two side walls 14, lying proximate to the bridge 15, allow articulated coupling between the coupling plate 9 and the first lever 2 in the pivot 21; the holes 19, which are further spaced with respect to the bridge 15, allow the articulated connection of the coupling plate 9 to the arm 22 in the pivot 23.

A pivot 24 is inserted in the upper holes 20 and is rotationally coupled to the top 7*a*; thereby the first elastic means 4 act between the pivot 24 and the connecting bridge 12 and transmit the thrust to the first lever 2.

The first lever 2 is constituted by a body 25 having two side walls 26 which are connected by a central bridge 27 and have respective arms 28 protruding on the opposite side with respect to the lug-shaped tabs 11.

The ends of the tabs 11 are interconnected by the connecting bridge 12 and the body 25 is constituted by a single part.

Each side wall 26 has at least three holes: a first hole 29, which is formed proximate to the tab 11 for the insertion of the pivot 21 that articulates the first lever 2 to the coupling plate 9; a second intermediate hole 30, for the insertion of a pivot 31 for the articulation of the first lever 2 to the second lever 3; and a third end hole 32, which is formed in the arm 28 for the articulated coupling of the first lever 2 to the arm 10 in the pivot 33.

Figure 7:
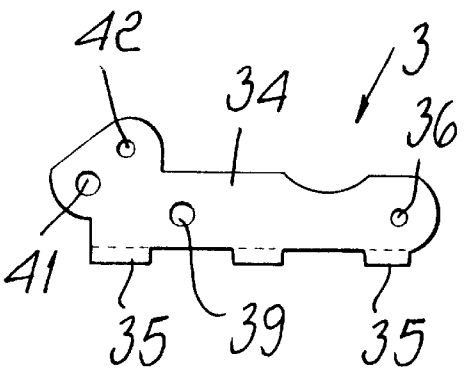
FIG. 7 is a side view of the second lever of the hinge according to the invention.
Figure 8:
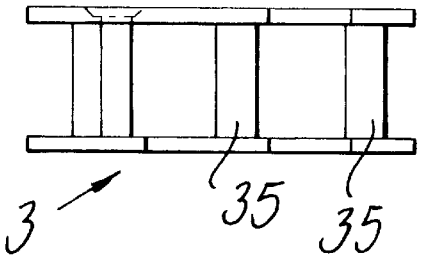
FIG. 8 is a top view of the second lever of FIG. 7.

The second lever 3 (FIGS. 7 and 8) is constituted by two side walls 34 which are interconnected by dorsal bridges 35 and in which there are provided four holes: an end hole 36, for the insertion of a pivot 37 for the articulation of the second lever 3 to a fixing plate 38; a hole 39, for the insertion of a pivot 40 for mutually coupling the second lever 3 and the arm 22; a hole 41, in which the pivot 31 is inserted; and a hole 42, in which a pivot 43, which rotationally couples to the bottom 6*b* of the second elastic means 5, can be inserted.

Alternatively, the pivot 43 can be replaced with a ventral bridge, which is not shown.

In the second elastic means 5, the top 7*b* is articulated to the pivot 33; accordingly, said means act between the arm 10 and the second lever 3, resting respectively in the pivots 33 and 43, and transmit the thrust to the first lever 2 about the pivot 31.

The first articulated quadrilateral is constituted by the coupling plate 9, the arm 22, the second lever 3 and the first lever 2, which are articulated in the pivots 23, 40, 31 and 21 respectively; the second articulated quadrilateral is constituted by the fixing plate 38, the arm 10, the first lever 2 and the second lever 3, which are articulated in the pivots 44, 33, 31 and 37 respectively.

Figure 2:
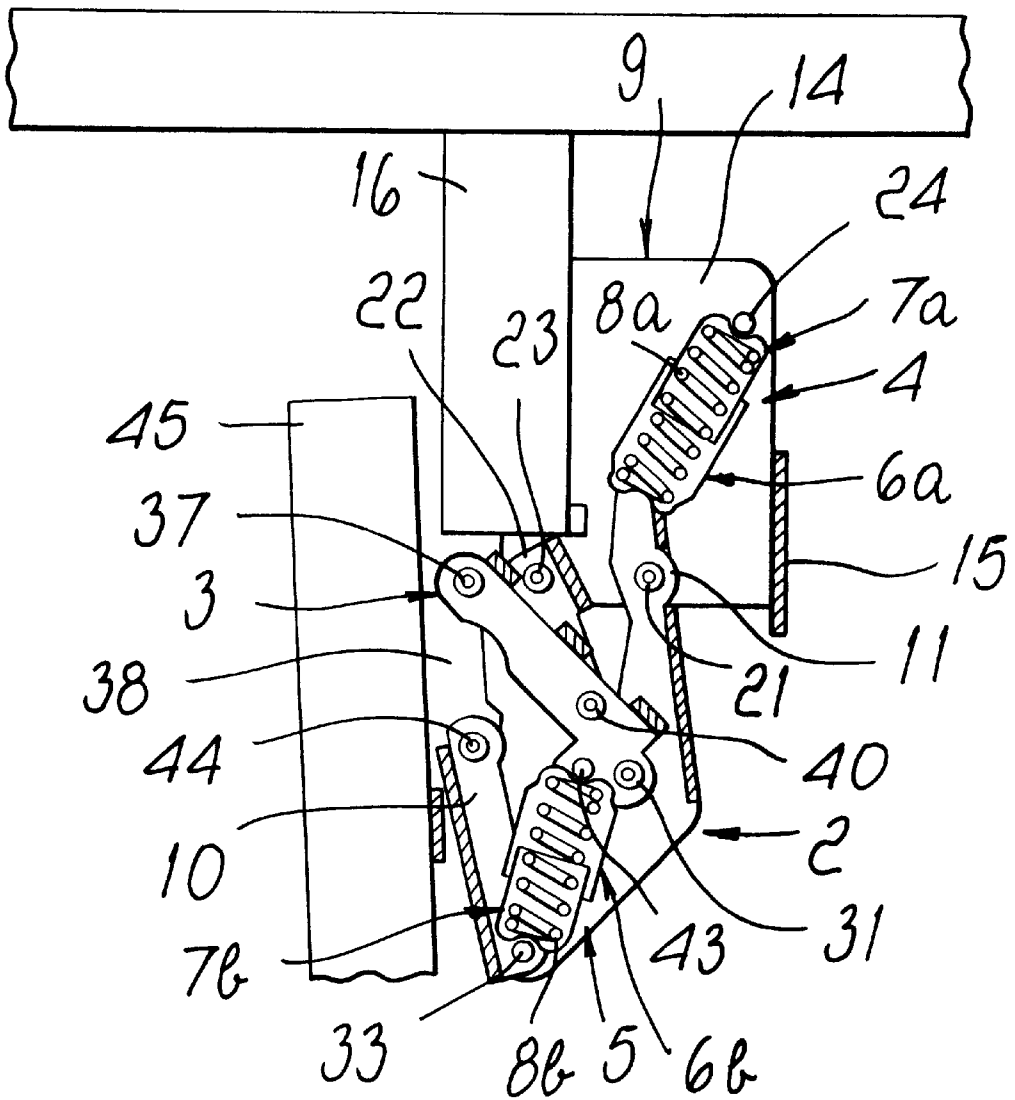
FIG. 2 is a sectional side view of the hinge of FIG. 1, with the elements in the closed configuration.
Figure 3:
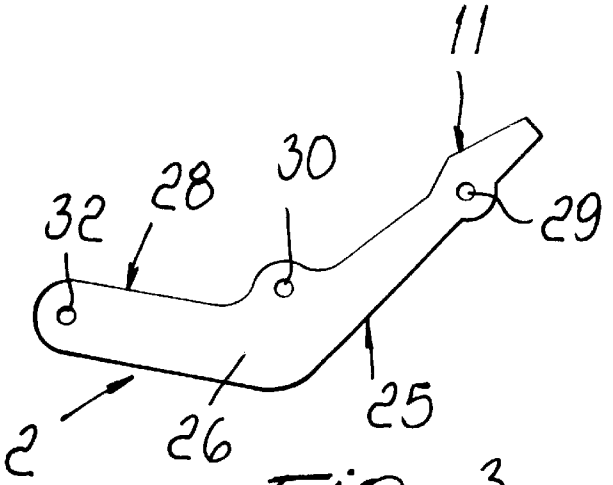
FIG. 3 is a side view of the first lever of the hinge according to the invention.
Figure 4:
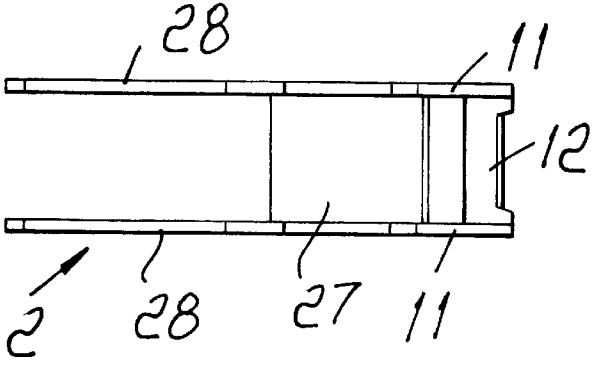
FIG. 4 is a top view of the first lever of FIG. 3.

The fixing plate 38 is anchored to the lower panel-like element 45, shown in the open configuration in FIG. 1 and in the closed configuration in FIG. 2.

Accordingly, the forces applied by the first elastic means 4 on the connecting bridge 12 and the forces applied by the second elastic means 5 on the pivot 43 affect the first lever 2.

The first lever 2 is provided as a single part whose length is such as to provide an arm being long enough to integrate the thrust for supporting the lower panel-like element 45, particularly supporting its weight when it is in the horizontal configuration with respect to the fixed vertical upper element 16.

In an alternative embodiment, not shown, the elastic means 4 and 5 can be constituted by two springs being arranged in parallel between the lower and upper guiding and supporting elements.

In practice it has been observed that the sprung hinge according to the invention achieves the intended aim and objects.

The invention thus conceived is susceptible of numerous modifications and variations, all of which are within the scope of the appended claims.

All the details may further be replaced with other technically equivalent ones.

In practice, the materials used, as well as the shapes and the dimensions, may be any according to requirements without thereby abandoning the scope of the protection of the appended claims.

The disclosures in Italian Utility Model Application No. MO2000U000017 from which this application claims priority are incorporated herein by reference.

What is claimed is:

1. A sprung hinge for supporting panel-like closure elements, comprising:

a first articulated quadrilateral and a second articulated quadrilateral which share a first lever and a second lever;

a coupling plate connectable to a panel-like closure element; and at least first and second elastic means, arranged in series, which act on mutually opposite parts of each one of said quadrilaterals; and wherein said at least first and second elastic means comprise each at least one spring and two mutually opposed elements, said two mutually opposed elements including a bottom element and a top element for guiding and supporting said at least one spring, said top element of said first elastic means being anchored to said coupling plate and said bottom element of said first elastic means being articulated to said first lever, said top element of said second elastic means being anchored to an arm of said second quadrilateral and said bottom element of said second elastic means being articulated to said second lever; and said first lever has, at a first end thereof, two lug-shaped tabs that extend toward said coupling plate, said tabs being adapted to be articulated to the bottom element of said first elastic means.

2. The hinge of claim 1, wherein said first lever is provided with a bridge for joining ends of said lug-shaped tabs, said bridge being monolithic with said tabs and having an outer surface thereof which is shaped for rotary coupling with the bottom element of said first elastic means.

3. The hinge of claim 1, wherein said first lever is constituted by a body comprising two side walls which have respective wall arms protruding on a side opposite with respect to said lug-shaped tabs, each one of said side walls being provided with at least three holes said three holes including a first hole located at said tab for articulated coupling to said coupling plate, an intermediate second hole, for articulated coupling to said second lever, and a third hole located proximate to an end of the respective wall arm for articulated coupling with the arm of said second quadrilateral.

4. A sprung hinge for supporting panel-like closure elements, comprising:

a first articulated quadrilateral and a second articulated quadrilateral which share a first lever and a second lever;

a coupling plate connectable to a panel-like closure element; and at least first and second elastic means, arranged in series, which act on mutually opposite parts of each one of said quadrilaterals; and wherein said at least first and second elastic means comprise each at least one spring and two mutually opposed elements, said two mutually opposed elements including a bottom element and a top element for guiding and supporting said at least one spring, said top element of said first elastic means being anchored to said coupling plate and said bottom element of said first elastic means being articulated to said first lever, said top element of said second elastic means being anchored to an arm of said second quadrilateral and said bottom element of said second elastic means being articulated to said second lever; and said first lever comprises two lug-shaped tabs, provided at a first end thereof so as to extend toward said coupling plate, and a bridge that joins said tabs, said bridge being coupled by a rotary coupling with the bottom element of said first elastic means.

5. The hinge of claim 4, wherein said first lever is constituted by a body comprising two side walls which have respective wall arms protruding on a side opposite with respect to said lug-shaped tabs, each one of said side wails being provided with at least three holes said three holes including a first hole located at said tab for articulated coupling to said coupling plate, an intermediate second hole, for articulated coupling to said second lever, and a third hole located proximate to an end of the respective wall arm for articulated coupling with arm of said second quadrilateral.

6. The hinge of claim 5, wherein said first lever with said side walls, said bridge and said wall arms has a monolithic structure.

7. A sprung hinge for supporting panel-like closure elements, comprising:

a first articulated quadrilateral and a second articulated quadrilateral which share a first lever and a second lever;

a coupling plate connectable to a panel-like closure element; and at least first and second elastic means, arranged in series, which act on mutually opposite parts of each one of said quadrilaterals: and wherein said at least first and second elastic means comprise each at least one spring and two mutually opposed elements, said two mutually opposed elements including a bottom element and a top element for guiding and supporting said at least one spring, said top element of said first elastic means being anchored to said coupling plate and said bottom element of said first elastic means being articulated to said first lever, said top element of said second elastic means being anchored to an arm of said second quadrilateral and said bottom element of said second elastic means being articulated to said second lever; and said first lever comprising: a body formed by two side walls; two lug-shaped tabs provided at respective first ends of said side walls so as to extend toward said coupling plate for articulation to the bottom element of said first elastic means; respective wall arms protruding at a second, opposite end of said side walls, one of said side walls being provided with at least three holes said three holes including a first hole located at a corresponding one of said tabs for articulated coupling to said coupling plate, an intermediate second hole, for articulated coupling to said second lever, and a third hole located proximate to an end of the respective wail aim for articulated coupling with the arm of said second quadrilateral.

8. The hinge of claim 7, wherein said first lever is further provided with a bridge which joins ends of said lug-shaped tabs, said bridge being monolithic with said tabs and having an outer surface thereof which is shaped for rotary coupling with the bottom element of said first elastic means.

9. The hinge of claim 8, wherein said first lever with said side walls, said bridge and said wall arms has a monolithic structure.

* * * * *